US005795638A

United States Patent [19]

Röder et al.

[11] Patent Number: 5,795,638

[45] Date of Patent: *Aug. 18, 1998

[54] ARRANGEMENT FOR THE ATTACHMENT OF A PAPER WEB LEADING EDGE ON A PAPER SUPPLY ROLL

[75] Inventors: Klaus Walter Röder; Hartwig Horst Trutschel, both of Würzburg, Germany

[73] Assignee: Koenig & Bauer-Albert Aktiengesellschaft, Wurzburg, Germany

[ * ] Notice: The term of this patent shall not extend beyond the expiration date of Pat. No. 5,647,547.

[21] Appl. No.: 502,779

[22] Filed: Jul. 14, 1995

[30] Foreign Application Priority Data

Jul. 14, 1994 [DE] Germany ..... 44 24 888.1

[51] Int. Cl.[6] ..... B65H 19/18

[52] U.S. Cl. ..... 428/57; 428/101; 428/105; 428/195; 428/198; 242/160.1

[58] Field of Search ..... 428/57, 58, 98, 428/101, 105, 195, 198; 242/160.1

[56] References Cited

U.S. PATENT DOCUMENTS 3,806,388 4/1974 Contini .

5,647,547 7/1997 Roder et al. ..... 242/160.1

FOREIGN PATENT DOCUMENTS

| | | |
|---|---|---|
| 0 166 884 | 8/1982 | European Pat. Off. . |
| 1 815 782 | 11/1969 | Germany . |
| 2 155 352 | 5/1972 | Germany . |
| 41 18 690 | 5/1993 | Germany . |
| 4-12953A | 1/1992 | Japan . |
| 4-93381A | 3/1992 | Japan . |
| 5-190015A | 7/1993 | Japan . |

OTHER PUBLICATIONS

JP52-43242 considered to the extent described in the IDS filed Aug. 26, 1997, Oct. 1977.

*Primary Examiner*—Kathleen Choi
*Attorney, Agent, or Firm*—Jones, Tuller & Cooper, P.C.

[57] ABSTRACT

An arrangement for the attachment of a paper web leading edge on a paper supply roll utilizes a rapidly setting material, such as a hot melt adhesive in the form of beads, drops or dots to attach the leading edge of the first paper web layer to the second layer. The drops or beads may bridge the junction of the leading edge with the second layer. Strings or threads, which are attached to the dots of the rapidly setting adhesive, may bridge the juncture.

9 Claims, 2 Drawing Sheets

ARRANGEMENT FOR THE ATTACHMENT OF A PAPER WEB LEADING EDGE ON A PAPER SUPPLY ROLL

FIELD OF THE INVENTION

The present invention is directed generally to an arrangement for the attachment of a paper web leading edge on a paper supply roll. More particularly, the present invention is directed to an arrangement for the attachment of a leading edge of a first layer of a paper web to a second layer of the paper web on a paper supply roll. Most specifically, the present invention is directed to an arrangement for the attachment of the start of a first layer of a paper web to a second layer of the paper web on a paper supply roll in preparation for connecting the paper web leading edge with a running paper web. The connection of the start of the paper web is accomplished during a flying roll change. The attachment arrangement of the leading edge of the paper web is accomplished by the use of a suitable hot melt or similar adhesive which may be applied in a pattern of beads or drops and may be in conjunction with interconnecting strings or threads.

DESCRIPTION OF THE PRIOR ART

In the operation of web-fed printing presses, the paper web is supplied from a large paper supply roll. As the paper web is withdrawn from the supply roll, it eventually becomes necessary to switch the web feed from a first, now depleted paper supply roll to a second, fresh paper supply roll. In order to maintain production speed and to avoid the need to stop and start the printing press each time a change in paper supply roll must be made, such changes are accomplished with the press operating at full speed. These paper supply roll changes are typically accomplished in what is called a flying roll change. In such a change, a leading edge of a new paper supply roll, which roll has been brought up to an appropriate rotational speed, is adhered to the web from the now nearly depleted supply roll. Various arrangements of tapes and adhesives are known for use in accomplishing the adherence of the leading end of a fresh paper supply roll to the web from a dwindling roll.

One method and an associated device for preparing a gluing point of a material supply roll for a flying roll change is set forth in German patent Publication DE 41 18 690 C2. In this procedure, the start of the first layer of paper on the supply roll is provided with a perforation in the form of a line that is parallel to, and spaced from the leading edge of the material web. A holding adhesive is applied to the undersurface of the first layer between its leading edge and the perforation. This holding adhesive attaches the first layer to the second layer of paper on the paper supply roll. A connecting adhesive is applied to the outer surface of the first layer behind or after the perforation, as viewed in the direction of paper web travel. This connecting adhesive is used to glue the first layer of the new paper supply roll to the web from the depleted paper roll during a flying roll change. The holding adhesive is intended to hold the paper supply roll tightly wound and to prevent the leading edge form unrolling during handling and transport of the paper supply roll.

A limitation of this prior art method and arrangement for attaching the first layer of the paper web to the second layer of the paper web is that is requires the use of a holding adhesive which must be applied between the two web layers. This requires a manual manipulation of the top paper layer and the placement of the holding adhesive between the two layers. Such a manipulation is not easily accomplished in an automatic manner and typically requires the services of a technician or press operator.

It will thus be seen that there is a need for accomplishing the attachment of the lading edges of a first paper web to the surface of a second paper web layer which avoids the limitations of the prior art. The arrangement for attachment of a paper web leading edge on a paper supply roll in accordance with the present invention accomplishes this result and is a significant improvement over the prior art.

SUMMARY OF THE INVENTION

It is an object of the present invention to provide an arrangement for the attachment of a paper web leading edge on a paper supply roll.

Another object of the present invention is to provide an arrangement for the attachment of a leading edge of a first layer of a paper web to a second layer of the paper web on a paper supply roll.

A further object of the present invention is to provide an arrangement for the attachment of a leading edge of a first layer of a paper web to a second web layer of the paper web on a paper supply roll in preparation for a flying roll change.

Yet another object of the present invention is to provide an arrangement for the attachment of a first layer of a paper web to a second layer of a paper web which can be accomplished without it being necessary to apply adhesive to the undersurface of the leading edge of the first paper web layer.

As will be discussed in greater detail in the description of the preferred embodiments which are presented subsequently, the attachment of the leading edge or start of the first layer of a paper web to an outwardly facing surface of a second layer of a paper web on a paper supply roll, as must be done when preparing the paper supply roll to be utilized in a flying roll change, is done by using a rapidly setting material, such as a hot melt adhesive, which is attached to the outwardly facing surfaces of both the first and second paper web layers. The adhesive may be applied in a pattern of beads or drops or may be in the form of spaced dots that are connected by threads or strings. In all instances, it is not necessary to raise the first layer of the paper web in order to interpose the adhesive between the first and second paper web layers.

The arrangement for the attachment of the lading portion of the first paper web layer to the second layer of the paper web in accordance with the present invention has several advantages over the prior art. The attachment of the two webs to each other can be accomplished manually as well as by simple automated mechanical devices. There is no need to form perforation sin the paper web. There is also no need to employ any of the various prior art web attachment tags or "butterflies" which are quite elaborate in their fabrication and which are frequently difficult to attach and hard to use.

The attachment arrangement in accordance with the present invention utilizes a hot melt adhesive which is easy to work with, has rapid setting times and controllable adhesive characteristics. This allows the paper supply rolls to be made up in a short period of time.

The adhesive strength of the start of the first layer of the paper web to the second layer of the paper web can be adjusted quickly and easily to proper selection and sizing of the hot melt adhesive. The spacing between the beads or drops of the hot melt adhesive can also be varied to provide the appropriate adhesive characteristics based on the paper quality. When the first layer of the paper web is separated from the second layer, the adhesive spots will tear at predetermined tear points. This allows the tearing movement, and thus the connection of the leading edge of the new web to the depleting web to be accomplished in a controlled manner.

The arrangement for the attachment of a paper web leading edge of a paper supply roll to a surface of a second layer of the paper web on the supply roll in accordance with the present invention overcomes the limitations of the prior art. It is a substantial advance in the art.

BRIEF DESCRIPTION OF THE DRAWINGS

While the novel features of the arrangement for the attachment of a paper web leading edge on a paper supply roll in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
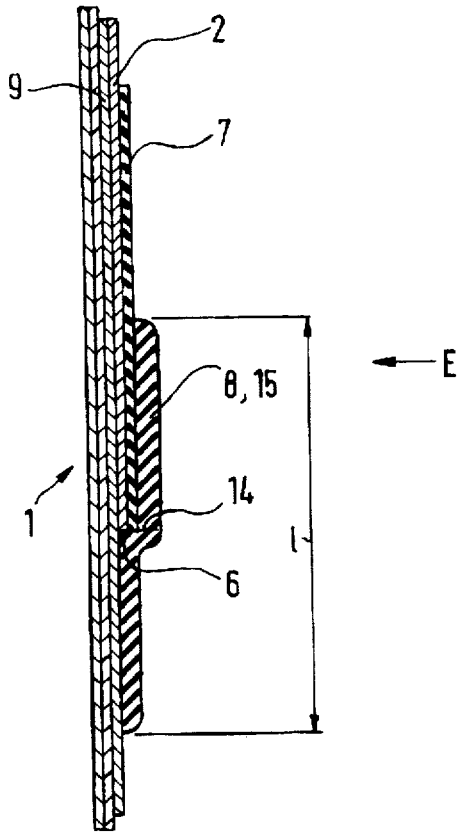
FIG. 1 is a cross-sectional view through the first several layers of a paper supply roll and showing a first preferred embodiment of an attachment arrangement in accordance with the present invention.
Figure 2:
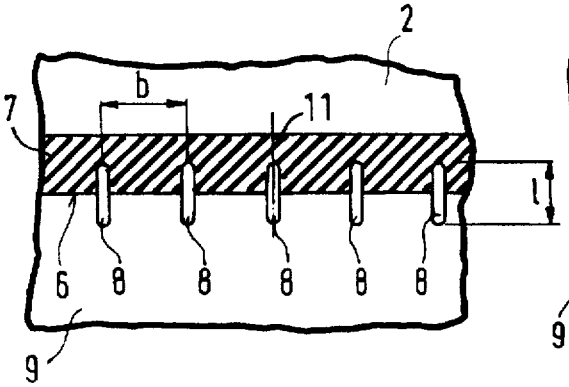
FIG. 2 is a plan view of a portion of FIG. 1, as indicated at E, and showing a portion of a web adhesion area.

Referring initially to FIGS. 1 and 2, there may be seen a first preferred embodiment of an arrangement for the attachment of a paper web leading edge 6 on a paper web roll, generally at 1, to an outer surface of a second paper layer 9 in accordance with the present invention. The paper web roll 1 is intended to be used as a fresh supply roll that will be used in a flying roll change in a web-fed rotary printing press. The leading edge or start 6 of a first layer 2 of the paper web roll 1 will be attached to the paper web from a depleting paper supply roll during the flying roll change. As may be sen in FIG. 2, the start or leading edge 6 of the first paper web layer 2 extends generally parallel to an axis of rotation of the paper web roll 1. A suitable strip shaped connecting adhesive 7, which will be used to connect the leading edge 6 of the new web to the depleting web that is about to run out is placed on the first layer 2 of the paper web generally parallel to the leading edge 6 of the first layer 2. This connecting adhesive 7 is a generally known glue applied to the first layer 2, or may be a separate two-sided glue strip. One of the long sides of this connecting adhesive 7 can extend congruently with the start 6 of the first layer 2 of the paper web to be adhered to the depleting web. Alternatively, the connecting adhesive 7 can be placed on the outer surface of the paper web 2 with the edge spaced at a distance "a" with respect to the start or leading edge 6 of the outer web 2, as is depicted in FIG. 4.

In accordance with the present invention, the attachment of the leading portion 6 of the outer or first paper web layer 2 to the second paper web layer 9 is preferably accomplished by the use of a rapidly settable material such as a hot melt adhesive 15. This adhesive 15 can be applied in the form of a plurality of individual, circumferentially extending beads 8, as are shown in FIGS. 1 and 2. Each such bead 8 of the hot melt adhesive 15, extends across the start 6 of the first paper web 2. Preferably, half of each bead 8 is on the start 6 of the first paper web 2 and half of each bead 8 is on the second layer 9. Each bead 8 of hot melt adhesive 15 has a linear axis 11 which extends generally in the direction of paper web feed off the roll; i.e. in a direction parallel to the longitudinal sides of the paper web. These beads 8 of the hot melt adhesive 15 are spaced across the width of the paper web roll 1 and are spaced at a distance "b" from each other. This bead spacing distance "b" is selected in an arbitrary manner based on the weight of the paper. The length "l" of each of the beads 8 can be as long as the width of the strip of the strip-shaped connecting adhesive 7. The hot meld adhesive 15 used to form the beads 8 should consist of 100% solid components, should not contain water or volatile or flammable solutions, should rapidly set after application and should provide rapid attraction and minimal shrinkage. It will be understood that these beads 8 of the hot melt adhesive 15 are intended to be used to hold the start 6 of the first paper layer 2 to the surface of the second paper layer 9 during handling of the paper roll 1. When the flying roll change is accomplished, these beads 8 will either separate from the paper or will rip the paper adjacent the bead. The hot melt adhesive functions as a holding adhesive in contrast to the connecting adhesive 7 which connects the leading portion 6 of the first layer 2 of the new paper web roll 1 to the traveling web from the depleting roll.

The hot melt adhesive 15 can be applied in the form of beads 8 manually by use of a glue gun or by simple mechanical application devices. The connection of the paper web of the supply paper roll 1 to the paper web from the depleting paper web roll can be accomplished in a generally known manner, such as is shown in the German Patent Publication DE 42 10 329 A1. In this flying roll change process, the paper web from the depleting paper roll is contacted by a pressure roller and is pressed into contact with the fresh paper supply roll 1 which has been brought up to a corresponding rotation speed. When this is done, the connecting adhesive 7 on the start 6 of the first layer 2 of the fresh paper web roll 1 will be attached or connected to the depleting web. Following the connection of the two webs together, the spaced beads 8 of the hot melt adhesive 15 will tear at their tear points 14, as seen in FIG. 1 with these tear points 14 being at the start 6 of the first paper web layer 2. A portion of each of the beads 8 of the hot melt adhesive 15 will thus remain on the start 6 of the first paper web layer 6 and a portion of each bead 8 will stay on the second layer 9 of the paper web.

Figure 3:
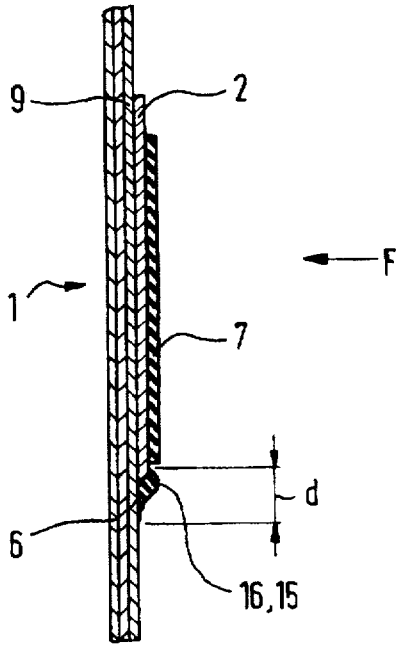
FIG. 3 is a view similar to FIG. 1 and showing a second preferred embodiment.
Figure 4:
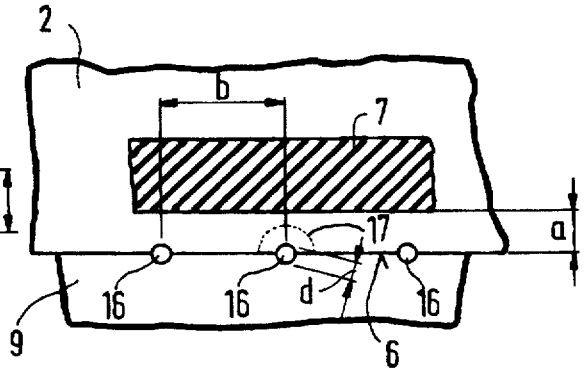
FIG. 4 is a view similar to FIG. 2, and taken in the direction indicated by the arrow F in FIG. 3 and showing a portion of a web adhesion area.

Turning now to FIGS. 3 and 4, there may be seen a second preferred embodiment of an arrangement for the attachment of a paper web leading edge on a paper supply roll in accordance with the present invention. In this second preferred embodiment, there is again provided a generally strip-shaped connecting adhesive 7 which is situated generally at the start 6 of the first paper web layer 2. This strip 7 of connecting adhesive can have its leading edge either congruent with the start 6 or its leading edge can be spaced from the start 6 of the first layer 2 of the paper web by a distance "a". In this second preferred embodiment, the start 6 of the first paper web layer 2 is attached to the second paper web layer 9 by a plurality of circular drops 16 of the hot melt adhesive 15. These drops are spaced from each other by a drop spacing distance "b". The distance "a" by which the edge of the connecting adhesive 7 may be spaced from the leading edge 6 of the first web 2 may be up to three times that of a diameter "d" of each of these hot melt adhesive drops 16. The drop spacing distance "b" for the drops 16 of the second preferred embodiment can be generally the same as the bead spacing distance "b" for the first preferred embodiment. In this second preferred embodiment, the drops 16 of the hot melt adhesive 15 are applied in the same manner and operate in the same way as discussed previously in connection with the first preferred embodiment. Once the connecting adhesive 7 has engaged the depleting paper web, the leading edge 6 of the first paper web layer 2 will typically separate from the second layer 9 in the area of semicircular-like tearing spots 17 which surround the adhesive drops 16. These drops 16 will tend to remain on the outer surface of the second layer 9 of the paper web on the fresh paper supply roll 1.

While the drops 16 of the hot melt adhesive 15 have been described as being generally circular and with a diameter "d", it will be understood that these drops 16 could be triangular, star-shaped, oval or of any other desired arbitrary geometrical shape. It will also be understood that the leading edge or start 6 of the first paper web layer 2 could extend obliquely to the axis of rotation of the paper supply roll or could be in the form of a V, a W, or a double-W. It will further be understood that the beads 8 or drops 16 of the hot melt adhesive 16, as well as the strip 7 of the connecting adhesive will follow this shape.

Figure 6:
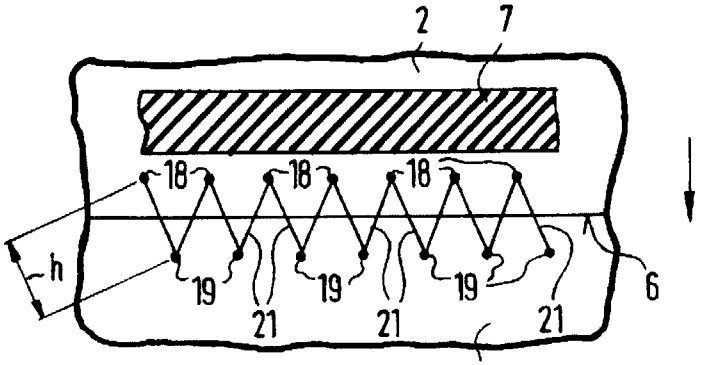
FIG. 5–7 show several representations of a third preferred embodiment of the present invention and depict a web adhesion area in plan view.
Figure 5:
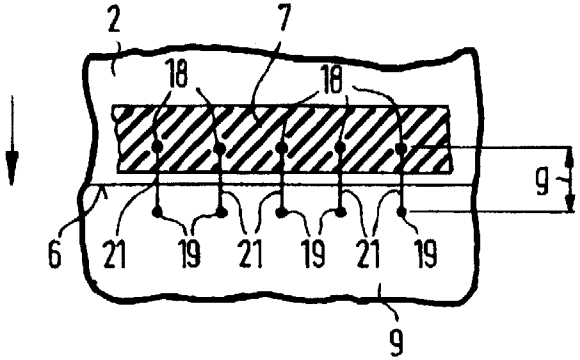
Figure 7:
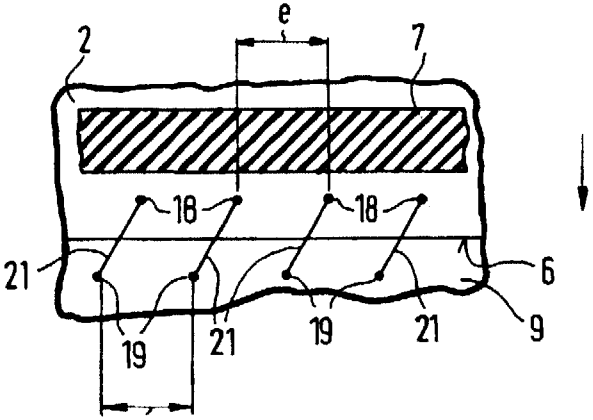

Referring now to FIGS. 5, 6 and 7, there may be seen several variations of a third preferred embodiment of an arrangement for the attachment of a paper web leading edge of a paper supply roll in accordance with the present invention. In this third embodiment, a plurality of dots 18 of the hot melt adhesive 15 are applied to the leading portion 6 of the first paper web layer 2, generally in the area of the connecting adhesive 7. A plurality of corresponding dots 19 of the hot melt adhesive 15 are applied to the second paper web layer 9. These first layer adhesive dots 18 and the corresponding second layer adhesive dots 19 are each spaced across the width of the paper web at a dot width spacing distance "e" as is indicated in FIG. 7. The first layer dots 18 are spaced from the second layer dots 19 in the direction of paper web conveyance, as indicated by the arrow to the left of FIG. 5, a straight distance "g" shown in FIG. 5, or an angled distance "h" shown in FIG. 6. Preferably, half of each of these dot spacing distances "g" or "h" falls on either side of the leading edge 6 of the first paper web layer 2. These dots 18 and 19 can be arranged directly opposite each other or longitudinally in the direction of web travel, as seen in FIG. 5, or can be offset or at intervals from each other in the direction of paper web travel, as seen in FIGS. 6 and 7.

Each of the first layer dots 18 is connected to at least one of the second layer dots 19 by the use of a string or thread 21. These strings or threads 21 extend generally longitudinally between their respective dots 18 and 19, as seen in FIGS. 5–7 and cross the leading edge 6 of the first paper web 2. These strings 21 can extend straight in the direction of paper web travel with each string 21 being attached to only one first layer dot 18 and to only one second layer dot 19, as seen in FIG. 5. Alternatively, a running length of string 21 can be attached between successively alternating dots 18 and 19 in a zig-zag manner, as is depicted in FIG. 6. In a third variation, as seen in FIG. 7, associated dots 18 and 19 could be connected by individual obliquely directed strings or threads 21.

The strings or threads 21 can be inserted into the dots 18 and 19 of the hot melt adhesive 15 before the adhesive has solidified. It is also possible to use a string 21 that has been covered with a sheath of the hot melt adhesive 15 or that has been encircled with particles of the hot melt adhesive 15. Where a frictional contact is made between these strings 21 and a heated tool, such as a heated die, the hot melt adhesive sheath or particles will soften so that the string 21 can be connected to the dots 18 and 19 of the hot melt adhesive 15. These strings 21 provided with a hot melt adhesive can also adhere to the portions of the first paper web 2 and the second paper web 9 which they contact. It will be understood that the strings 21 depicted in the three variations of the third preferred embodiment of the invention, as shown in FIGS. 5, 6 and 7 could either be plain or could be provided with the sheath or the particles of the hot melt adhesive 15. It is also possible, in accordance with the present invention to provide the string 21 with dots of the hot melt adhesive 15 already attached to them at appropriately spaced instances. This allows the drops 18 and 19 of the hot melt adhesive 15 and the strings 21 to be attached to the first paper web layer 2 and to the second paper web layer 9 on either side of the leading edge 6 in one process. The use of a suitable heated tool, such as a heated die then allows the connections to be made between the hot melt adhesive dots 18 and 19 and the strings 21 to the paper webs and the dots 18 and 19 to the strings 21 all at the same time.

The strings or threads 21 can be made so that they will tear or break rapidly. Natural fibers, such as cotton or silk could be used for the strings 21. Alternatively, hard-to-tear materials, such as synthetic fibers, such as nylon could be used. When a hard-to-tear string 21 is provided, the string 21 will tear away from the dots 18 and 19 of the heat activated adhesive. If the strings 21 are made of an easily tearable or breakable material, the strings 21 themselves may break. It is also possible to make the strings 21 of the hot melt adhesive.

Figure 8:
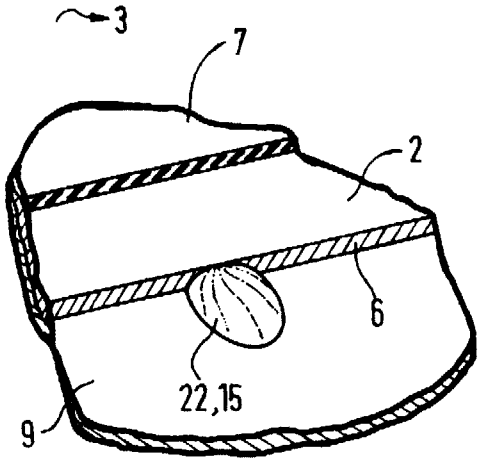
FIG. 8 is an enlarged perspective view of a portion of a web adhesion area of a fourth preferred embodiment of the attachment arrangement in accordance with the present invention.

Turning finally to FIG. 8, there may be seen a fourth preferred embodiment of an arrangement for the attachment of a leading edge of a paper web on a paper supply roll in accordance with the present invention. In this fourth embodiment, several drops 22 of the hot melt adhesive 15 can be placed on the second layer 9 of the paper web 1. These drops 22 will be spaced across the paper supply roll 1 at the point of overlap of the leading portion 6 of the first paper web layer 2 with the second paper web layer 9. In this fourth embodiment, only a portion of the periphery of each drop 22 of the hot melt adhesive 15 is in contact with the leading edge 6 of the paper web 2. The periphery of the drop 22 of the hot melt adhesive 15 abuts the edge 6 of the first paper web layer 2. In this fourth embodiment, the strip-shaped connecting adhesive 7 can be applied to the first paper web layer 2 with its leading edge spaced from the leading portion 6 of the first web 2, as depicted in FIG. 8, or the connecting adhesive 7 could be applied with its leading edge congruent, as depicted in FIG. 2.

Instead of using a hot melt adhesive 15, which is no longer adhesive after it has set, it is also possible to use a reaction adhesive as the rapidly setting material 15. Such a reaction adhesive is one which sets by means of a chemical reaction. This setting or solidification takes place either physically, for example by cooling; i.e. by evaporation of solvents or dispersion agents, or chemically. Either the physical or chemical setting of the reaction adhesive results in maximum strength.

It is also possible to electrostatically change a freshly cut, newly made leading edge of a paper supply roll. This electrostatic charge will hole the leading edge of the first layer of the paper web in place on the second layer of the paper web so that the strings, drops, beads or dots of the rapidly setting adhesive can be applied to the paper supply roll to accomplish the attachment of the leading edge in place. Suitable steps may be taken to provide the electrostatic charge during the cutting of the web.

While preferred embodiments of an arrangement for the attachment of a paper web leading edge of a paper supply roll in accordance with the present invention has been set forth fully and completely hereinabove, it will be apparent to one of skill in the art that a number of changes in, for example, the size of the paper supply roll, the specific connecting adhesive used, the drive for the supply roll and the like may be made without departing from the true spirit and scope of the present invention which is accordingly to be limited only by the following claims.

What is claimed is:

1. A paper supply roll having a first paper web layer with a leading edge portion, and a second paper web layer; said first paper web layer having a first group of dots of a material which rapidly sets at room temperature, said first group of dots being spaced along said first paper web layer adjacent said leading edge portion of said first paper web layer; a second group of dots of said material which rapidly sets at room temperature, said second group of dots being spaced along said second paper web layer; and string extending across said paper web leading edge between said first group of dots and said second group of dots and connecting dots in said first group of dots with dots in said second group of dots.

2. The paper supply roll of claim 1 wherein said string is synthetic fiber.

3. The paper supply roll of claim 1 wherein said string is a natural fiber.

4. The paper supply roll of claim 1 wherein said string is made of said material which sets rapidly at room temperature.

5. The arrangement of claim 4 wherein said material which sets rapidly at room temperature is a hot melt adhesive.

6. The paper supply roll of claim 1 wherein said string is a running length of string.

7. The paper supply roll of claim 1 wherein said string is a plurality of individual strings.

8. The paper supply roll of claim 1 further including a connecting adhesive extending along said leading portion of said first paper web layer adjacent said first group of dots.

9. The paper supply roll of claim 8 wherein said connecting adhesive is a strip.

* * * * *